US005179906A

United States Patent [19]

Kattwinkel et al.

[11] Patent Number: 5,179,906

[45] Date of Patent: Jan. 19, 1993

[54] WATERCRAFT

[76] Inventors: Hans H. Kattwinkel, Burgweg 66; Marcus Kattwinkel, Wiesenstr. 4, both of D-5884 Halver, Fed. Rep. of Germany

[21] Appl. No.: 499,312

[22] PCT Filed: Sep. 16, 1988

[86] PCT No.: PCT/DE88/00576

§ 371 Date: May 10, 1990

§ 102(e) Date: May 10, 1990

[87] PCT Pub. No.: WO89/04793

PCT Pub. Date: Jun. 1, 1989

[30] Foreign Application Priority Data

Nov. 13, 1987 [DE] Fed. Rep. of Germany ..... 3738617

[51] Int. Cl.[5] ..... B63B 35/73

[52] U.S. Cl. ..... 114/270; 114/121; 114/143

[58] Field of Search ..... 114/121, 122, 143, 124, 114/350, 91, 270, 191, 194

[56] References Cited

U.S. PATENT DOCUMENTS

| | | | |
|---|---|---|---|
| Re. 27,261 | 12/1971 | Bromell et al. | 114/122 X |
| 2,286,350 | 6/1942 | Drake | 114/270 |
| 3,483,844 | 12/1969 | Trantwein | 115/70 |
| 3,791,335 | 2/1974 | Del Vecchio | 114/270 |
| 3,807,333 | 4/1974 | Ross | 114/91 X |

FOREIGN PATENT DOCUMENTS

| | | | |
|---|---|---|---|
| 3543140 | 12/1985 | Fed. Rep. of Germany . | |
| 1332642 | 12/1964 | France . | |
| 12489 | 1/1986 | Japan | 114/122 |
| 927304 | 5/1963 | United Kingdom . | |

*Primary Examiner*—Sherman Basinger
*Attorney, Agent, or Firm*—Herbert Dubno

[57] ABSTRACT

A watercraft in which a beam having a seat for the user is supported by two stanchions pivotally connected to a support frame below the beam. A float elongated in the direction of travel of the watercraft is provided on an upper part of the frame below the beam while a ballast is provided on a lower part of the frame below the float. Between the float and the ballast, lateral arms of the support frame extend for engagement by the legs of the operator who can thereby swing the float and ballast assembly in a balancing operation during travel of the watercraft.

8 Claims, 3 Drawing Sheets

1
2
3
4
5
5'
6
7
7'

WATERCRAFT

CROSS REFERENCE TO RELATED APPLICATION

This application is a national phase of PCT/DE88/00576 filed Sep. 16, 1988 and based upon German national application P 37 38 617.4 filed Nov. 13, 1987 under the International Convention.

FIELD OF THE INVENTION

The invention relates to a watercraft with a float and a passenger stand or the like attached to the float, whereby the passenger stand is hinged by means of stanchions, whose hinge axes are mutually coaxial and axially parallel with respect to the propulsion direction of the watercraft and the stanchions are articulately linked to the passenger stand via height-adjustable connection elements linked to the passenger stand, whereby the length-adjustable connection elements are telescopic stanchions with hinge axes running parallel to the hinge axes of the stanchions, whereby further the length-adjustable stanchions can be controlled through a positioning drive, which detects the relative inclination of the position of the passenger stand and translates it into control signals in order to change the length of the stanchions, so that the passenger stand remains in an essentially vertical position.

BACKGROUND OF THE INVENTION

A watercraft of the aforedescribed type is known from DE 35 43 140 A1.

This watercraft, namely a boat, has to have a sufficient width in order to achieve travel stability. A very slim design of the floats with a relatively tall superstructure is not possible in this case, since the watercraft would be unstable and prone to capsizing.

In earlier systems of this type, the passenger stand is decoupled from the floating body (float body), so that the passenger stand, i.e. a platform for aircraft, does not necessarily have to follow the motions of the floating body produced by waves and wind, but can be kept independently in a horizontal position.

However, in this case, as a result of the large float which is used, only relatively low speeds of the watercraft can be reached in spite of high energy expenditure.

OBJECT OF THE INVENTION

It is the object of the invention to create a watercraft which can carry a tall superstructure in spite of a slim and narrow configuration and which can still be capsize-proof.

SUMMARY OF THE INVENTION

According to the invention, a ballast is attached by means of a support frame to the float, the passenger stand is articulately linked to the support frame via stanchions, and laterally on both sides of the support frame and perpendicularly to its longitudinal direction rigid support arms are provided, upon which the passenger stand is supported via length-adjustable connection elements.

Because of this construction, there is at least partial decoupling of the float and the passenger stand, so that the passenger stand does not necessarily have to follow the lateral movements of the float. Furthermore, the passenger stand can preserve its ideal position due to the length-adjustable connection elements resting against the stanchions, by correspondingly lengthening or shortening of the connection elements, independently of the relative position of the ballast with respect to the float. Hence, it is only necessary to provide a single, trim and narrow float or an assembly composed of several such trim and narrow floats arranged coaxially with respect to each other. This can result in a pendulum-like displacement of the buoyancy forces and the stabilizing forces sidewards to the left or to the right is achieved. The watercraft practically comprises a lower boat and an upper boat. The lower boat consists of the slim float and a ballast readily attached to its bottom. The upper boat located on top can exert a pressure on the sides of the lower boat through the length-adjustable lateral stanchions and the support frame, forcing the lower boat to move laterally.

Because of the resulting torque of the lower boat, the upper boat is correspondingly laterally supported. During the pendulum-like motion created by waves, the float can swing to one side and to the other.

Because of the trim shape of the float, it is possible for the watercraft to reach a relatively high speed with little energy consumption and with a considerable insensitivity to swell, particularly lateral swell.

An advantage of the invention is that a narrow, slim float with a weight (ballast) attached to its bottom, has a very quiet position in troubled waters, and that between the lower boat which is in the water and the upper boat freely rising above the water a clearance is provided, through which the moving water waves can pass. As a result of the trim construction of the float and ballast, a relatively small resistance to flow is created, which allows a speedy travel with little energy consumption. It is also possible to create stable travel conditions, even when the center of mass lies above the water level.

The length-adjustable telescopic stanchions can be actuated by an electric motor, pneumatically, hydraulically or by any other suitable means.

The watercraft of the invention has a float, and passenger stand or the like attached thereto and hinged to the float via stanchions whose hinge axes are coaxial with respect to one another and axially parallel to the propulsion direction of the watercraft.

A watercraft of this type, which can be used for sports, can have a ballast affixed via a support frame to the float, the passenger stand hinged to the support frame via stanchions, rigid support arms provided laterally on both sides of the support frame and perpendicularly to its longitudinal direction, the passenger stand formed as a beam with a seat and controls connecting its stanchions and coupled with a steering mechanism for the watercraft, and the free ends of the stanchions holder provided with elements articulately mounted to accommodate the feet and optionally the lower leg of the passenger.

In this embodiment, the upper boat is built as a seat for one person, and the stabilizing function is fulfilled by corresponding leg or foot movements of the person. The float displaced from the normal moves relatively upwardly, so that the foot of the person resting thereagainst can exert a corresponding pressure.

This way the position of the person or of the passenger stand on which the person is seated is stabilized.

The construction according to the invention can create a quasi double pendulum, which moves about the hinge axis in a trim configuration with high travel stability.

The watercraft according to the invention can serve as a watercraft for the hobby sportsman. By correspondingly exerting force with his legs, the sportsman operating the watercraft can balance the position of the passenger stand (seat) relatively to the position of the float with the ballast, through corresponding angling or stretching of one or the other leg.

Advantageously, to the rear of the passenger stand, with respect to the main travel direction, a drive unit is provided.

The usual units, such as outboard engines and the like, can be deployed as drive units.

The actuation of the drive units can thereby take place via lever mechanisms and cable lines, whose actuator or control is arranged on or close to the steering mechanism. This applies especially for watercraft which are small sportscraft for hobby purposes.

Advantageously the passenger stand can be arranged in a relatively median position and can be lockable with respect to the float.

Particularly in large watercraft, the passenger stand can be a cabin with a control console.

The ballast body can contain additional weight in the form of drive units, fuel, cargo and the like.

In this case the ballast body can have a tubular or similar shape, so that in its hollow inner space the additional weight can be arranged in a fixed or detachable manner.

The support frame can consist of narrow support struts.

Preferably a fin is attached to the support frame.

Due to the fin, the oscillating motions of the float together with the ballast with respect to the passenger stand are slowed down, which is advantageous for the balancing of its position.

BRIEF DESCRIPTION OF THE DRAWING

The above and other objects, features and advantages of our invention will become more readily apparent from the following description, reference being made to the accompanying highly diagrammatic drawing in which.

SPECIFIC DESCRIPTION

Figures 1A, 1B, 1C:
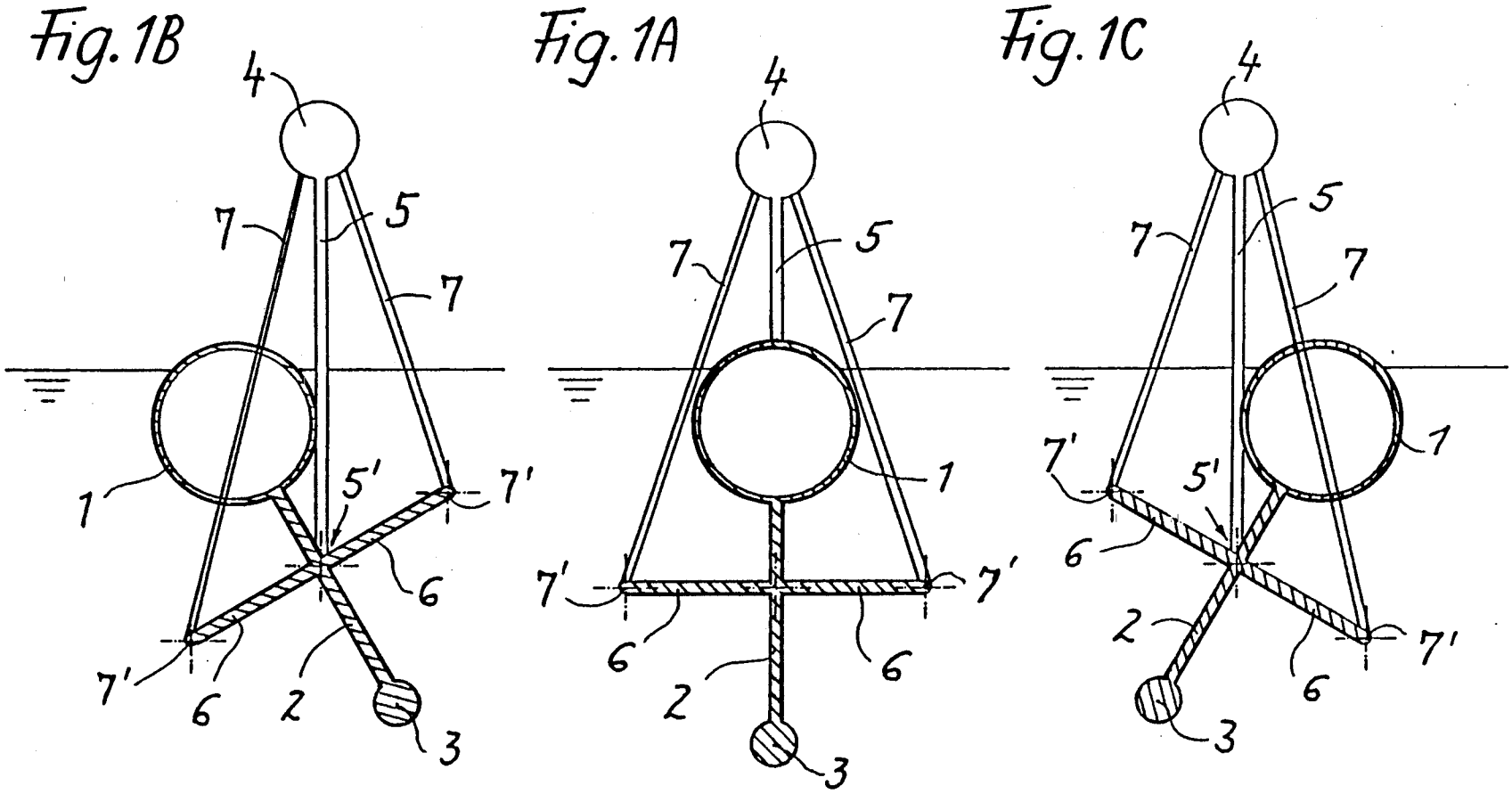
FIGS. 1A–1C are diagrammatic front views showing the principle of the watercraft according to the invention, in partial section.
Figure 2:
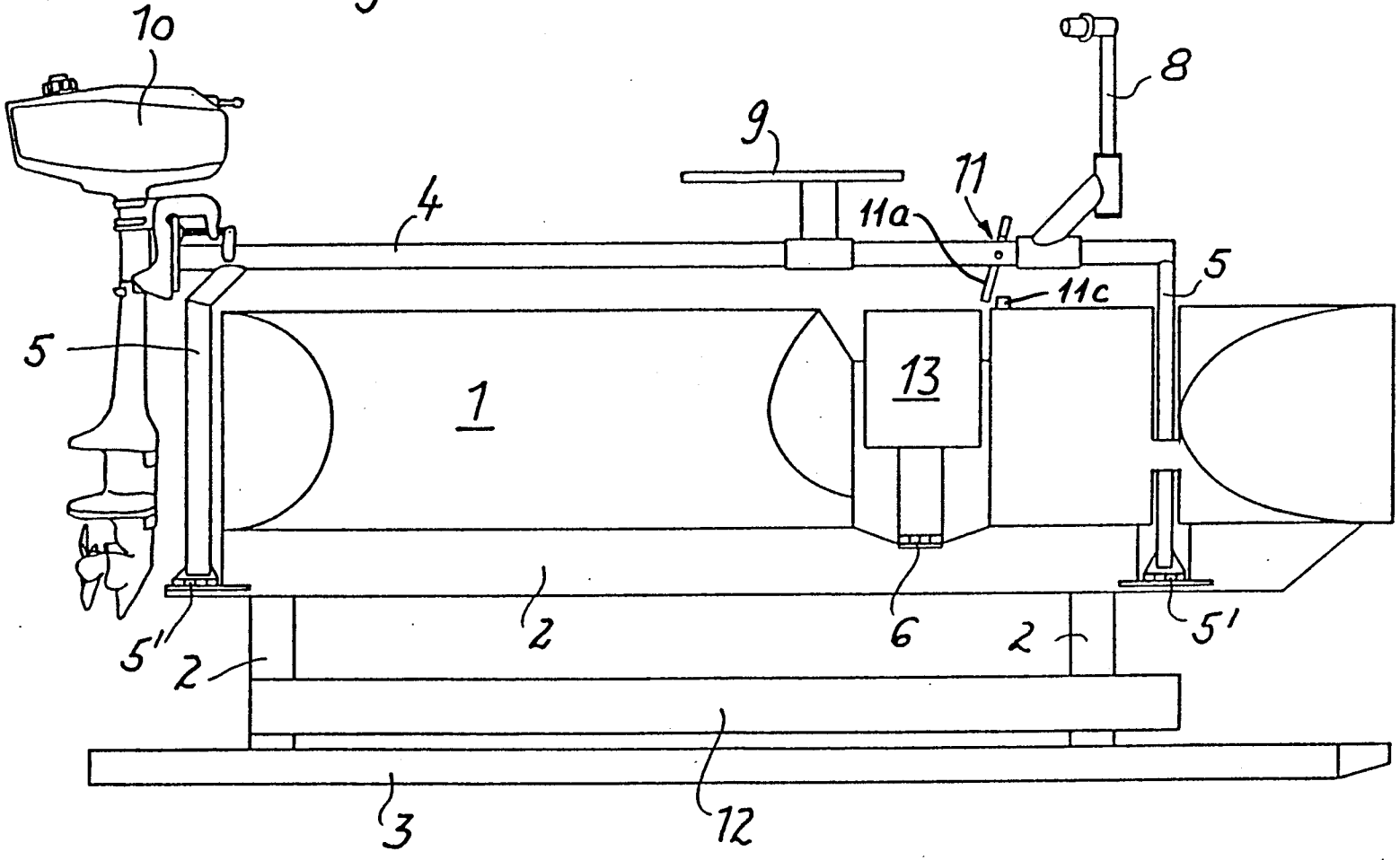
FIG. 2 is a side view of a single-seat watercraft for sports according to the invention.
Figure 4:
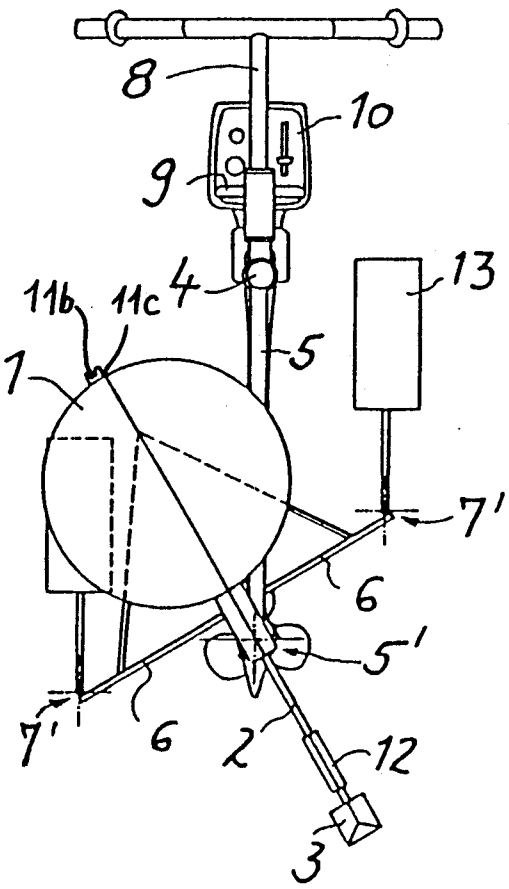
FIGS. 3 and 4 are front views of the watercraft according to FIGS. 2, in different relative positions.
Figure 3:
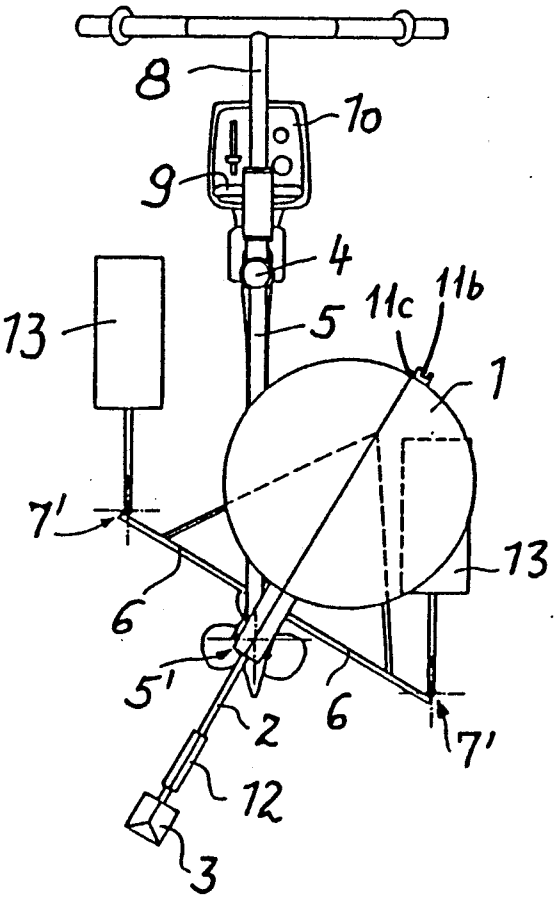

Basically, the watercraft consists of a float 1, of a ballast 3 attached to the float by means of a support frame 2, and of a passenger stand 4 (FIGS. 1A–1C). According to the invention, the passenger stand 4 is hinged to the support frame 2 via stanchions 5, whereby the hinge axes of the stanchions 5 are coaxial and axially parallel with respect to the propulsion direction of the watercraft. Laterally, on both sides of the support frame 2, rigid support arms 6 are arranged perpendicularly with respect to the longitudinal direction of the support frame. The passenger stand 4 is supported mostly by the free ends of the support arms 6, via length-adjustable connection elements 7. In the embodiment of FIGS. 2 to 4, the passenger stand 4 is designed like a crossbar connecting its stanchions 5, whereby on this crossbar controls 8 and seat 9 are mounted. The controls 8 are coupled via a rod assembly with a steering mechanism for the watercraft. In the embodiment of FIGS. 2 to 4, on the passenger stand 4 a drive unit 10 is swingably mounted for changing the direction of travel.

In the embodiment of FIGS. 2 to 4, the length-adjustable connection elements 7 were formed by the members of a person, particularly the legs of the user. In order to be able to keep the passenger stand in a relative middle position with respect to the float 1 when the watercraft is not in use, a locking device 11 in the form of a latch is provided, by means of which the position can be secured. When the watercraft is in use, this latch is released. The latch can have a swinging lever **11*a* engageable in a notch 11*b* on a formation 11*c* at the top of the float (FIGS. 2, 3 and 4**).

In the embodiment of FIGS. 1A–1C, the length-adjustable connection elements 7 are built as telescopic stanchions, whose end portions are hinged on the side of the support arms, whereby the hinge axes are parallel to the hinge axes of the stanchions 5 of the passenger stand.

The passenger stand according to the embodiment example of FIGS. 1A–1C can be a cabin with a control console, so that a number of people can be accommodated in this cabin. In the ballast body 3, as long as it is hollow additional weight in the form of drive units, fuel, cargo and the like can be introduced.

The support frame 2 can be formed by narrow connection bars, as can be seen especially in FIG. 2. Besides, a fin 12 or the like can be fastened to the support frame, which slows down the motions of the float and the ballast body.

The length-adjustable stanchions 7 can be controlled by means of a suitable positioning drive so that it detects the relative inclination of the passenger stand 4 and translates it into signals triggering the length change of the stanchions 7, so that the passenger stand remains basically perpendicular, respectively slightly inclined with respect to the normal, depending on the force of the wind. This position is maintained independently of the inclined position of the unit formed by the parts 1 and 3 with their pendulum-like motion.

The float is preferably barrel-shaped with pointed ends, as can be seen particularly clearly from FIG. 2. In addition, the float 1 is narrowed in the area of the seat 9 of the passenger stand 4, so that during a relatively inclined position of the float and the ballast body, a free space is left for the legs of the user, whose legs rest against the ends of the support arms 6. In order to accommodate the lower leg and the foot of the user, holding parts 13 are articulately mounted to the ends of the support arms 6, so that the legs of the user can preserve their vertical position, independently of the relative position of the support arms 6 with respect to the horizontal.

We claim:

1. A watercraft, comprising:

a float;

a support frame attached to said float;

a ballast attached to said support frame and spaced below said float;

a pair of upright stanchions spaced apart in a direction of travel and pivotally connected to said support frame between said float and said ballast at a pivot axis parallel to said direction;

a beam extending in said direction, rigidly connected to said stanchions and spaced above said float;

a passenger seat on said beam;

a steering mechanism operatively connected to said beam and effective for steering the watercraft;

a control on said beam operatively connected to said mechanism for operating same; and a pair of rigid support arms extending perpendicular to said direction and to said axis from opposite sides of said support frame and rigid therewith for displacement by legs of a passenger on said seat to shift said ballast and float angularly about said axis and relative to said beam and said stanchions.

2. A watercraft, comprising:

a float;

a support frame attached to said float;

a ballast attached to said support frame and spaced below said float;

a pair of upright stanchions spaced apart in a direction of travel and pivotally connected to said support frame between said float and said ballast at a pivot axis parallel to said direction;

a beam extending in said direction, rigidly connected to said stanchions and spaced above said float;

a passenger seat on said beam;

a steering mechanism operatively connected to said beam and effective for steering the watercraft;

a control on said beam operatively connected to said mechanism for operating same;

a pair of rigid support arms extending perpendicular to said direction and to said axis from opposite sides of said support frame and rigid therewith; and respective holders hinged to said support arms at outer ends thereof and engageable by legs of a passenger on said seat for displacement of said frame by the legs of the passenger to shift said ballast and float angularly about said axis and relative to said beam and said stanchions.

3. The watercraft defined in claim 2, further comprising a drive unit mounted on said beam rearwardly of said seat relative to said direction.

4. The watercraft defined in claim 3 wherein said drive unit is an outboard engine.

5. The watercraft defined in claim 2, further comprising a latch on said beam for releasably locking said float in a median position about said axis relative to said beam.

6. The watercraft defined in claim 2 wherein said frame is provided with a fin limiting angular oscillation of said frame about said axis.

7. The watercraft defined in claim 2 wherein said float is elongated in said direction and has a barrel shape with pointed ends.

8. The watercraft defined in claim 7 wherein said float is narrowed in a region of said seat.

* * * * *